US007151500B2

(12) United States Patent
Su et al.

(10) Patent No.: US 7,151,500 B2
(45) Date of Patent: Dec. 19, 2006

(54) ANTENNA ASSEMBLY HAVING PARASITIC ELEMENT FOR INCREASING ANTENNA GAIN

(75) Inventors: Wen Fong Su, Tu-Chen (TW); Yun-Lung Ke, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/123,343

(22) Filed: May 5, 2005

(65) Prior Publication Data

US 2006/0033666 A1 Feb. 16, 2006

(30) Foreign Application Priority Data

Aug. 10, 2004 (CN) ..... 2004 1 0041711

(51) Int. Cl.
*H01Q 9/16* (2006.01)

(52) U.S. Cl. ..... 343/795; 343/793

(58) Field of Classification Search ..... 343/700 MS, 343/795, 793

See application file for complete search history.

(56) References Cited

U.S. PATENT DOCUMENTS

| | | | | |
|---|---|---|---|---|
| 4,812,855 | A * | 3/1989 | Coe et al. | 343/818 |
| 6,100,848 | A | 8/2000 | Hayes | |
| 6,339,404 | B1 | 1/2002 | Johnson et al. | |
| 6,621,464 | B1 * | 9/2003 | Fang et al. | 343/795 |
| 6,624,793 | B1 * | 9/2003 | Su et al. | 343/795 |
| 6,791,506 | B1 * | 9/2004 | Suganthan et al. | 343/795 |
| 2004/0012534 | A1 * | 1/2004 | Dai et al. | 343/795 |
| 2004/0080464 | A1 | 4/2004 | Suganthan et al. | |
| 2004/0222936 | A1 * | 11/2004 | Hung et al. | 343/795 |
| 2005/0035919 | A1 * | 2/2005 | Yang et al. | 343/795 |

* cited by examiner

*Primary Examiner*—Tan Ho
(74) *Attorney, Agent, or Firm*—Wei Te Chung

(57) ABSTRACT

An antenna assembly (1) includes a substrate having a first surface (11) and a second surface (12) opposite to the first surface, a dual-band dipole antenna (5) having a symmetrical structure and arranged on the first surface, a feed cable (4) arranged on the first surface for feeding the dipole antenna, and a parasitic element (8) arranged on the second surface. The parasitic element has a pair of symmetrical first and second parasitic sections. The first parasitic section includes a first, a second and a third patches (61–63), and the second parasitic section includes a first, a second and a third pieces (71–73). The first, the second and the third patches are separated from each other. The first, the second and the third pieces are separated from each other. The parasitic element can increase the gain of the dipole antenna through coupling with the dipole antenna.

17 Claims, 9 Drawing Sheets

ANTENNA ASSEMBLY HAVING PARASITIC ELEMENT FOR INCREASING ANTENNA GAIN

BACKGROUND OF THE INVENTION

1. Field of the Invention

The present invention relates generally to an antenna assembly, and more particularly to a dual-band antenna assembly used for wireless local area network (WLAN).

2. Description of the Prior Art

In recent years, Wireless Local Area Network (WLAN) products applying with IEEE 802.11a/b/g standards, such as WLAN cards for computers are gaining popularity in wireless communication market. IEEE 802.11b/g standard is suitable for working at 2.4–2.5 GHz frequency band, while IEEE 802.11a standard is suitable for working at 5–6 GHz frequency band. Many of the WLAN products are wanted to be used under both IEEE 802.11a and IEEE 802.11b/g standard benefit from dual-band antennas.

For achieving dual-band effect, a dual-band dipole antenna is one of the most mature dual-band antennas in both design and manufacture.

A conventional dual-band dipole antenna is disclosed in U.S. Patent Application No. 2004/0080464 by Suganthan et al. Suganthan et al. discloses a printed dual-band dipole antenna comprising a substrate having a main surface and a first and a second dipoles forming on the main surface. The radiating portion of the first dipole and that of the second dipole are connected with each other. The ground portion of the first dipole and that of the second dipole are connected with each other. Therefore, for feeding the two dipoles, only one feed cable needs to be used. This conventional dual-band dipole antenna has a simple structure. However, when transmitting high-frequency signals under a lower power, this antenna exposes disadvantages of dissatisfactory low gain and narrow bandwidth.

Hence, in this art, a high gain dual-band antenna assembly to overcome the above-mentioned disadvantages of the prior art will be described in detail in the following embodiment.

BRIEF SUMMARY OF THE INVENTION

A primary object, therefore, of the present invention is to provide a high gain dual-band antenna assembly for operating in wireless communications under IEEE 802.11a/b/g standards.

In order to implement the above object and overcomes the above-identified deficiencies in the prior art, an antenna assembly of the present invention comprises a substrate having opposite first and second surfaces, a dual-band dipole antenna having a symmetrical structure and arranged on the first surface, a feed cable arranged on the first surface for feeding the dipole antenna, and a parasitic element arranged on the second surface. The parasitic element has a pair of first and second symmetrical parasitic sections. The first parasitic section comprises a first, a second and a third patches. The second parasitic section comprises a first, a second and a third pieces. The first, the second and the third patches are separated from each other. The first, the second and the third pieces are separated from each other. The parasitic element can increase the gain of the dipole antenna through coupling with the dipole antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
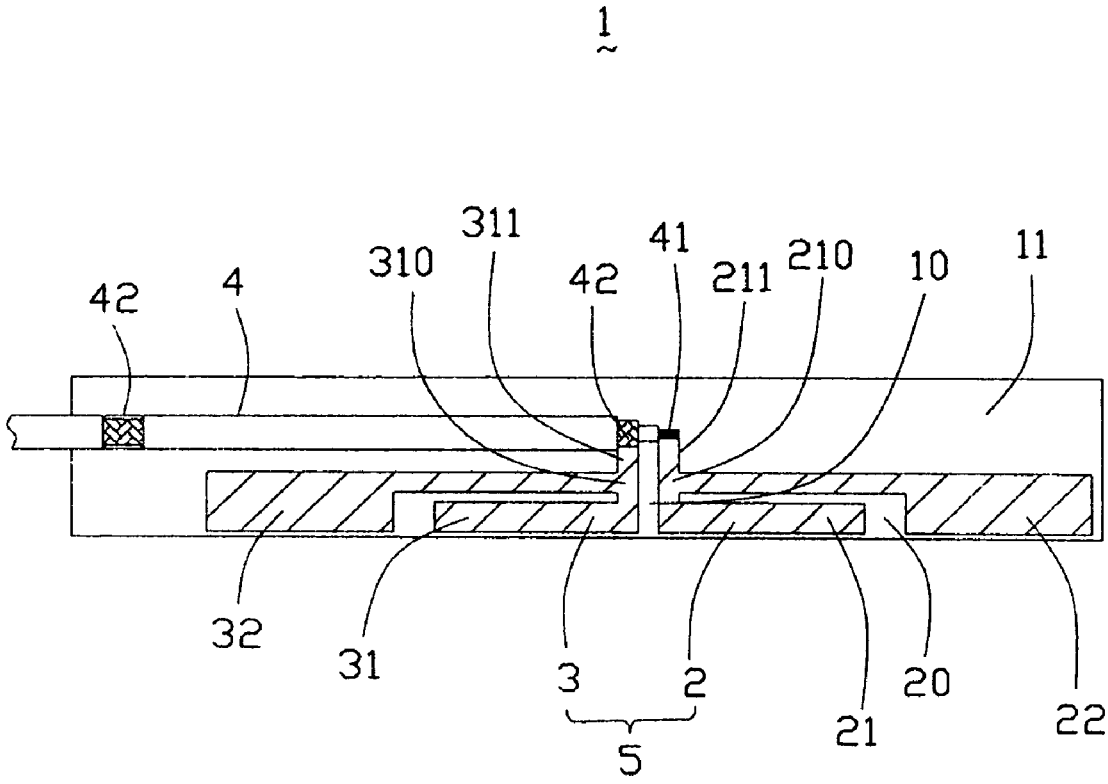
FIG. 1 is a top view of an antenna assembly according to the present invention.
Figure 2:
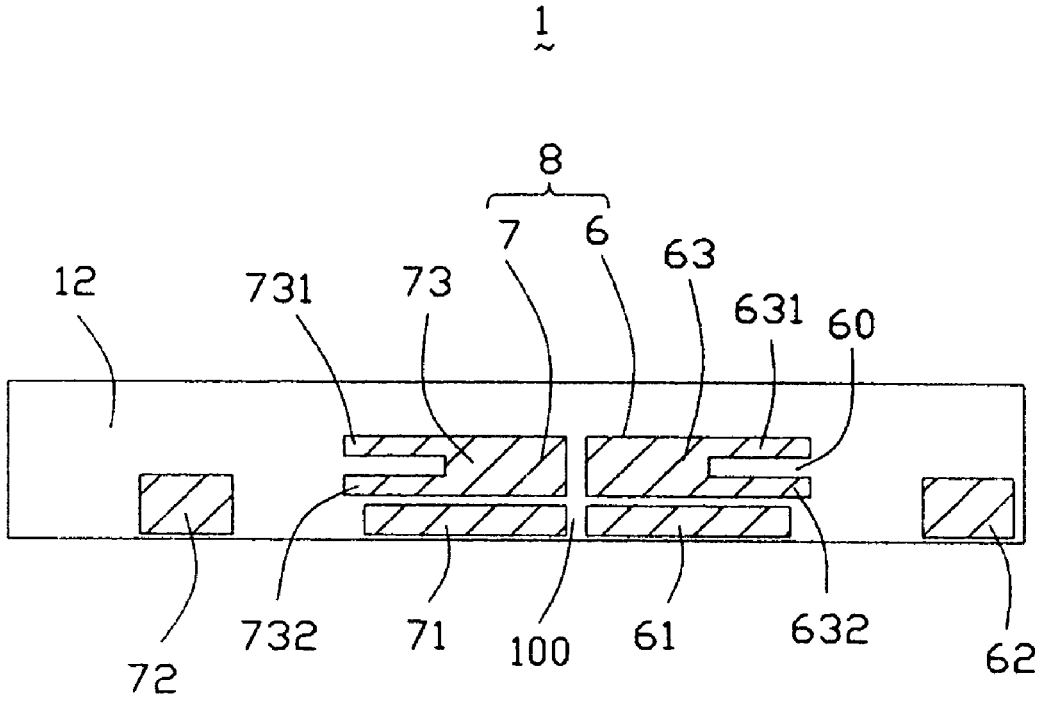
FIG. 2 is a back-side view of the antenna assembly according to the present invention.

Referring to FIGS. 1 and 2, an antenna assembly 1 according to the present invention comprises a substrate (not labeled), a dipole antenna 5, a feed cable 4 and a parasitic element 8.

The substrate in this preferred embodiment is a printed circuit board. The substrate is preferably substantially planar and rectangular. Alternative configurations of the substrate may also be practicable. The substrate defines opposite first and second main surfaces 11, 12, upon which the dipole antenna 5 and the parasitic element 8 of the antenna assembly 1 are formed, respectively and defines a lengthwise direction and a lateral direction perpendicular to the lengthwise direction.

Particularly referring to FIG. 1, the dipole antenna 5 comprises a radiating portion 2 and a ground portion 3. The radiating portion 2 and the ground portion 3 define a first slot 10 therebetween, according to which the radiating portion 2 and the ground portion 3 are symmetrically disposed. The radiating portion 2 is substantially rectangular and comprises an L-shaped first radiating section 21 and an inverted-L-shaped second radiating section 22 extending from a distal end 210 of the first radiating section 21. The first and the second radiating sections 21, 22 define an inverted-L-shaped slit 20 therebetween. The slit 20 has an open end on a longer edge of the rectangular radiating portion 2 and a closed end extending adjacent to the ground portion 3. The ground portion 3 comprises a first ground section 31 symmetrical with the first radiating section 21 and a second ground section 32 symmetrical with the second radiating section 22. Due to the ground portion 3 having the same structure as the radiating portion 2, the structure of the ground portion 3 will not be detailed introduced here. The first radiating section 21 and the first ground portion 31 corporately form a first dipole antenna operating at a first frequency band of 5.15–5.825

Figure 3:
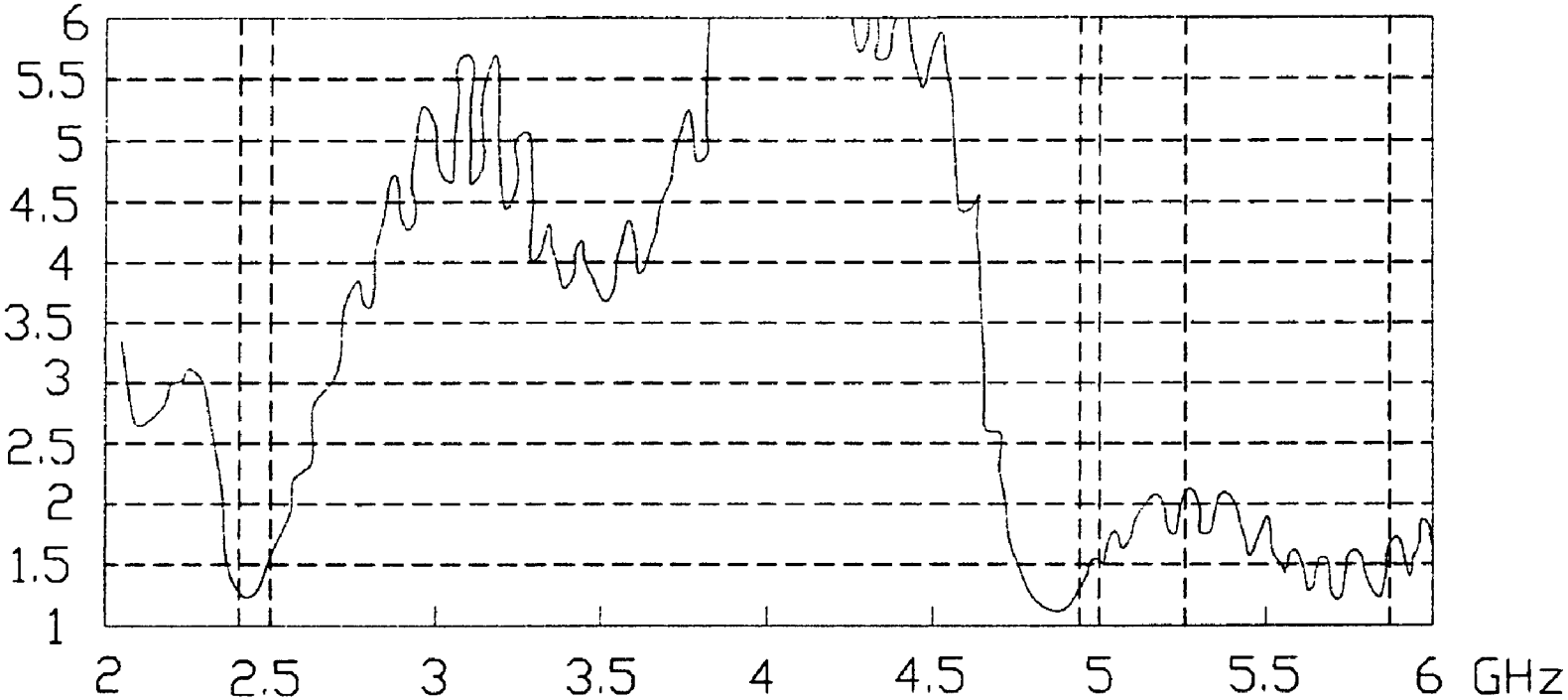
FIG. 3 is a test chart recording of Voltage Standing Wave Ratio (VSWR) of the antenna assembly as a function of frequency.
Figure 4:
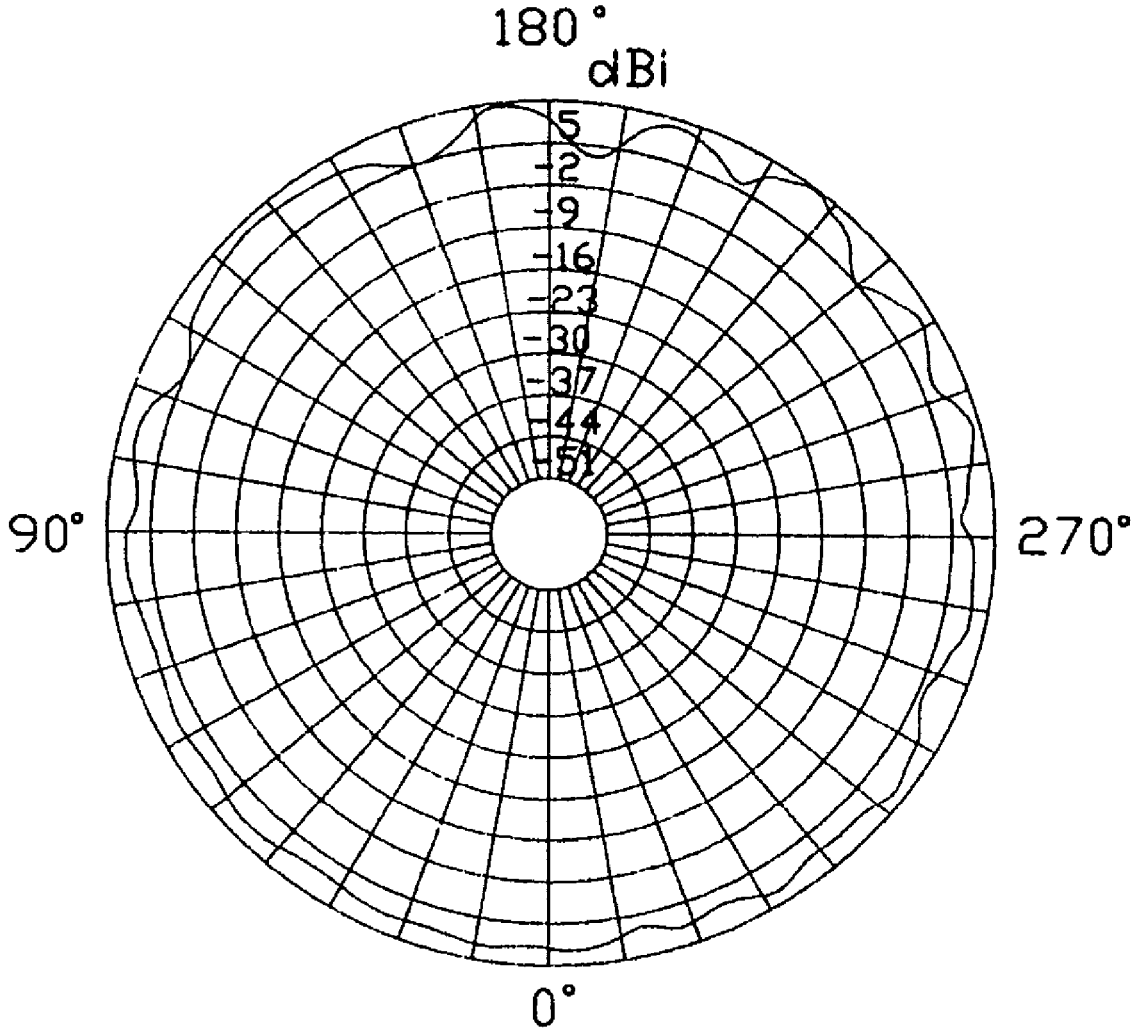
FIG. 4 is a vertically polarized principle plane radiation pattern of the antenna assembly operating at the resonant frequency of 2.484 GHz.
Figure 5:
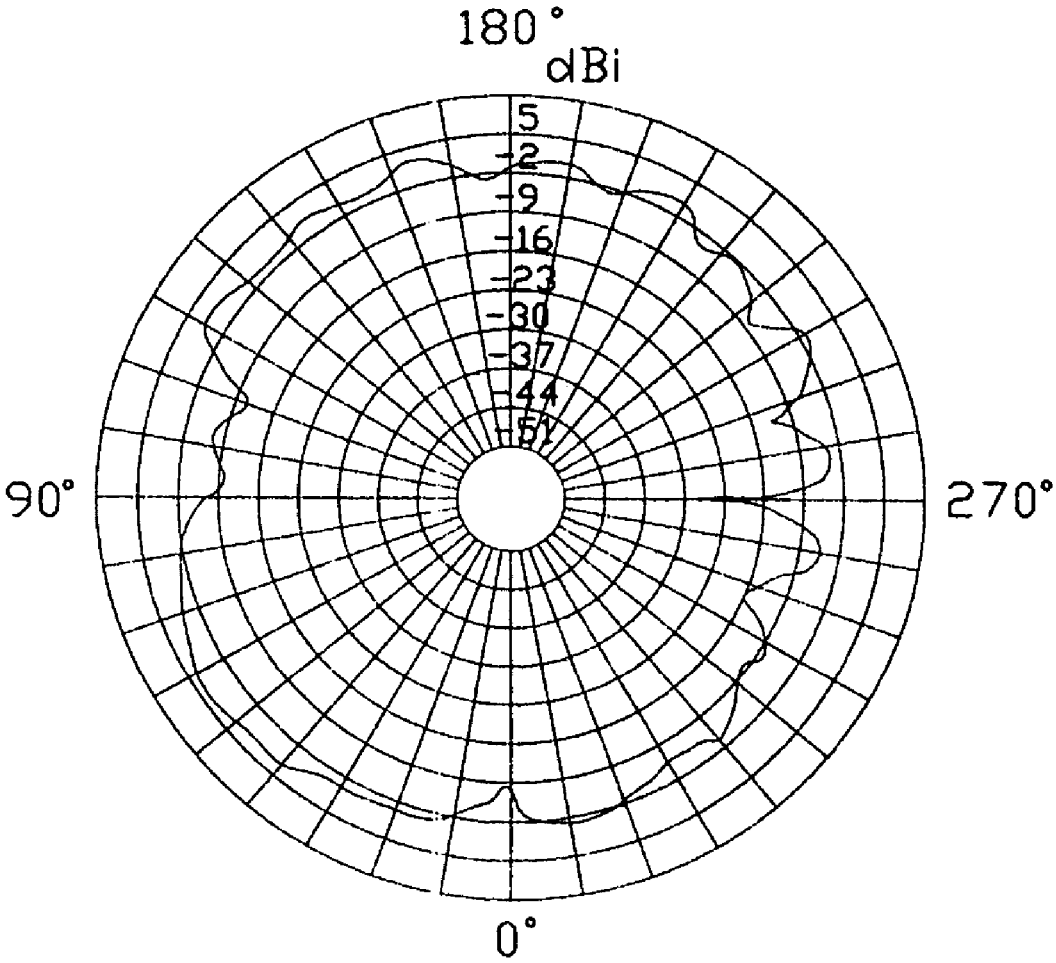
FIG. 5 is a horizontally polarized principle plane radiation pattern of the antenna assembly operating at the resonant frequency of 2.484 GHz.
Figure 6:
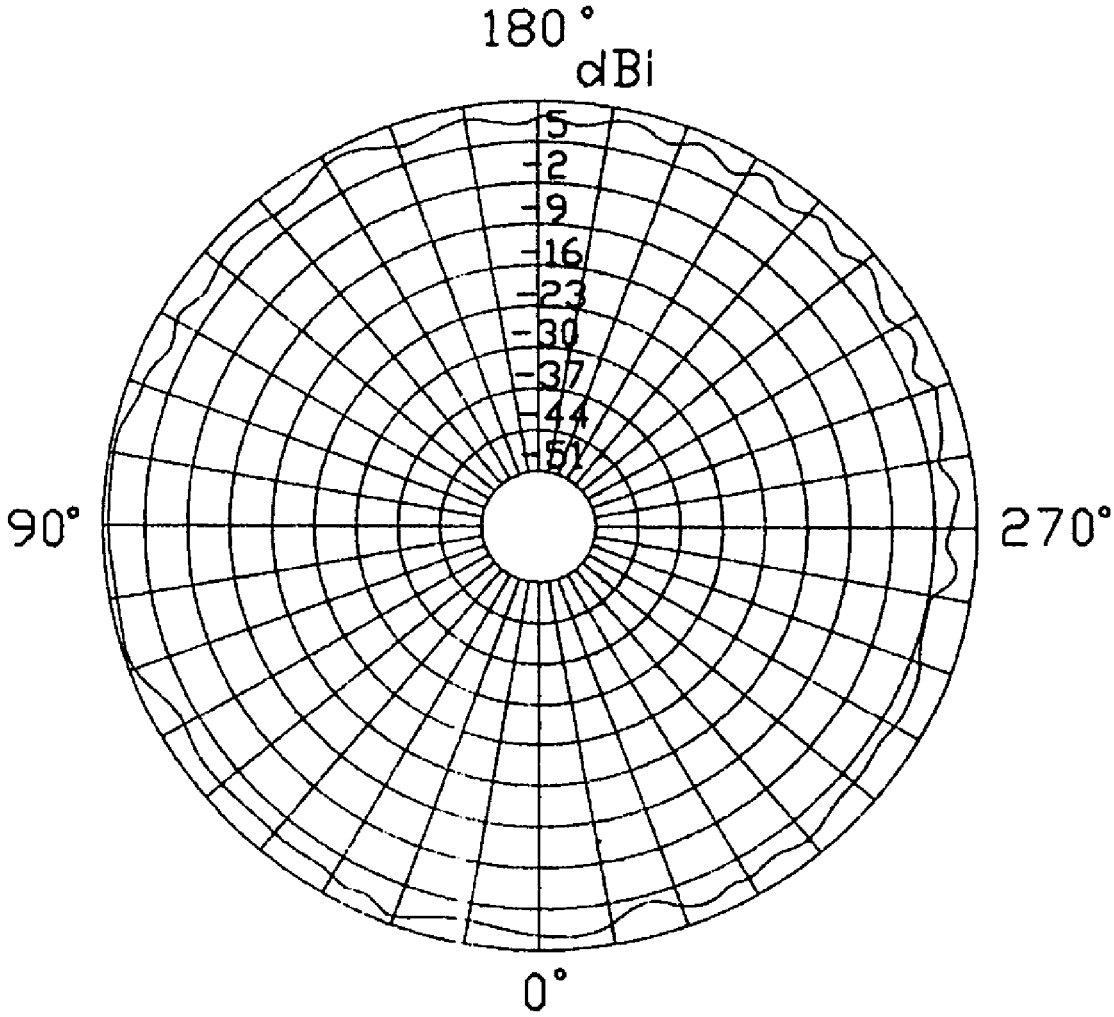
FIG. 6 is a vertically polarized principle plane radiation pattern of the antenna assembly operating at the resonant frequency of 4.990 GHz.
Figure 7:
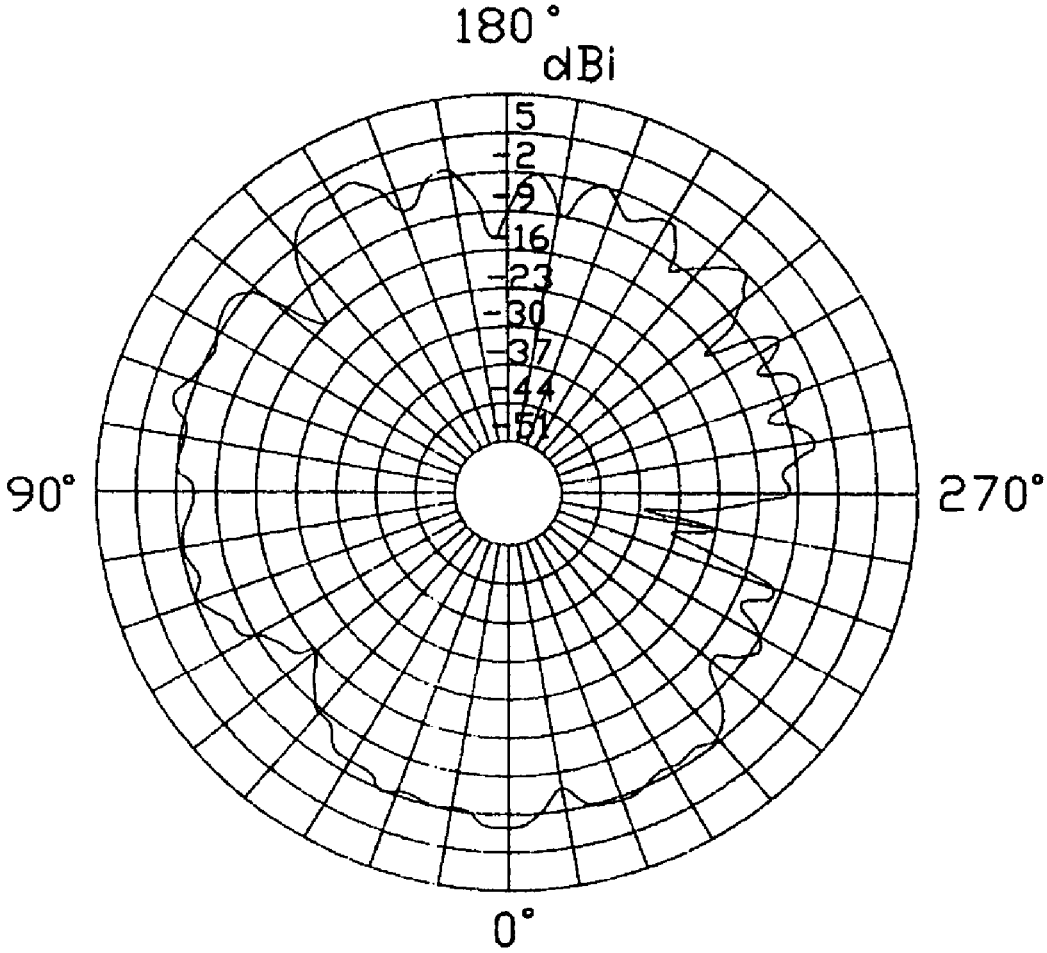
FIG. 7 is a horizontally polarized principle plane radiation pattern of the antenna assembly operating at the resonant frequency of 4.990 GHz.
Figure 8:
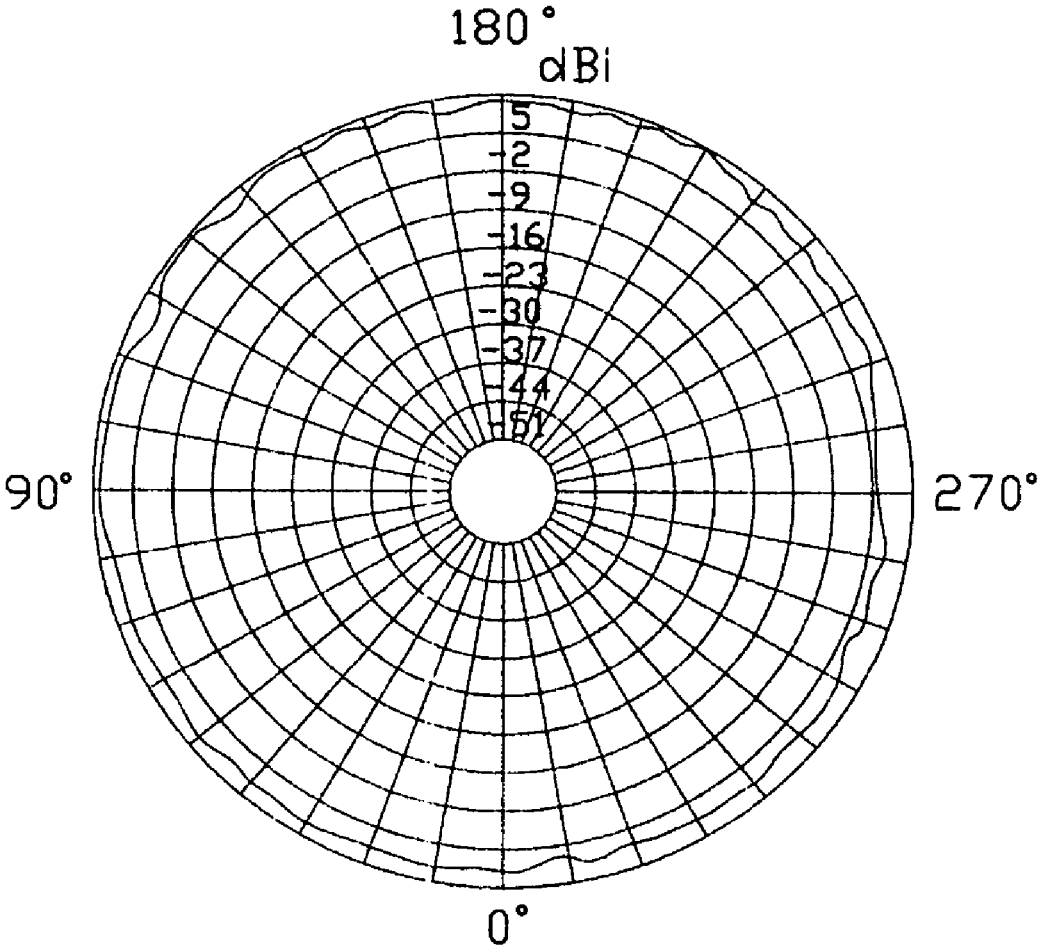
FIG. 8 is a vertically polarized principle plane radiation pattern of the antenna assembly operating at the resonant frequency of 5.850 GHz.
Figure 9:
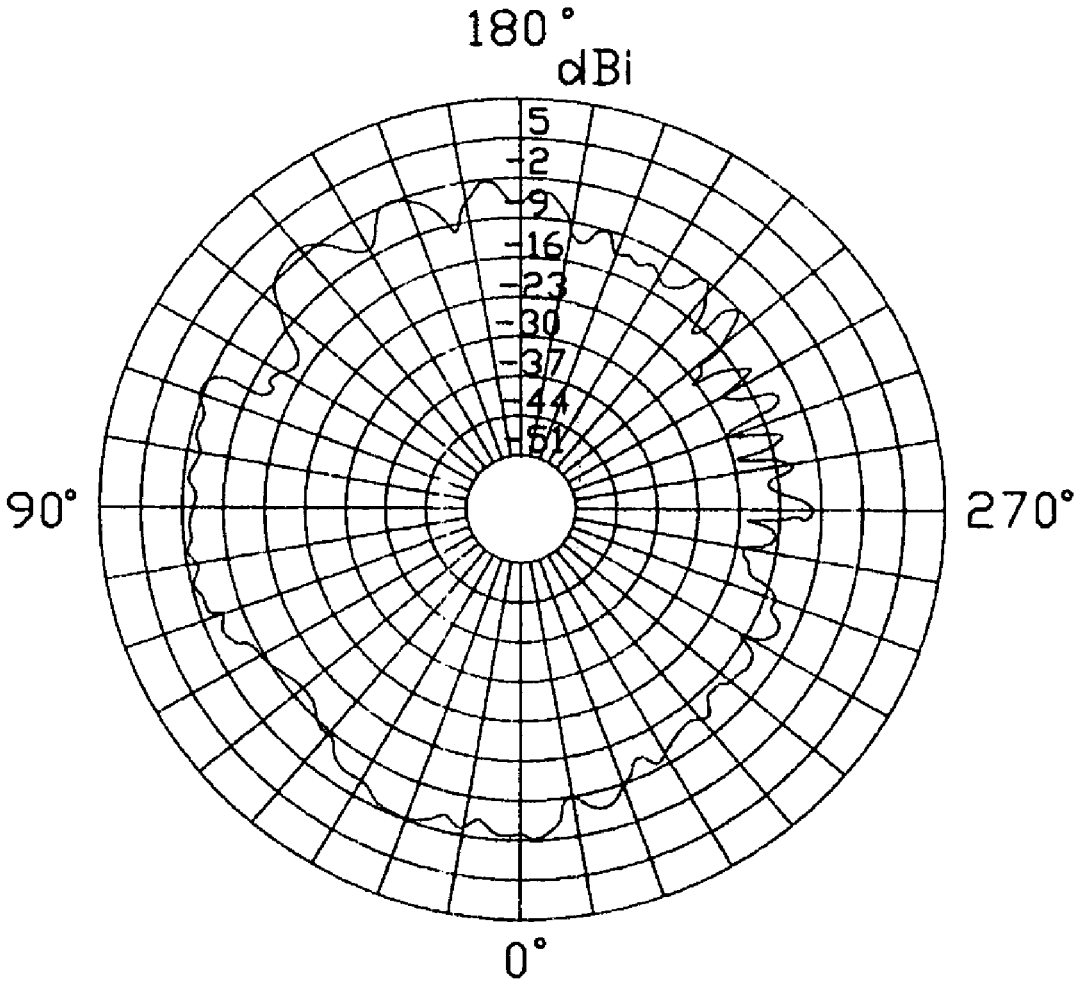
FIG. 9 is a horizontally polarized principle plane radiation pattern of the antenna assembly operating at the resonant frequency of 5.850 GHz.

GHz (referring to FIG. 3) with a first central frequency at 5.2 GHz, which covers the standard frequency band defined in IEEE 802.11a. An electrical length of the first radiating section 21 is about a quarter of a wavelength according to the first central frequency. The second radiating section 22 and the second ground portion 32 corporately form a second dipole antenna operating at a second frequency band of 2.4–2.5 GHz (referring to FIG. 3) with a second central frequency at 2.4 GHz, which covers the standard frequency band defined in IEEE 802.11b/g. An electrical length of the second radiating section 22 is about a quarter of a wavelength according to the second central frequency. A pair of metal strips 211, 311 are respectively extended from the distal end 210 of the first radiating section 21 and corresponding distal end 310 of the first ground section 31 for physically connecting with the feed cable 4.

The feed cable 4 in this preferred embodiment is a coaxial cable and comprises an inner conductor 41 exposed in one end of the coaxial cable and welded on the metal strip 211 of the radiating portion 2, and an outer conductor 42 exposed in the end and welded on the metal strip 311 of the ground portion 3. The other end of the feed cable 4 is connected with a radio frequency (RF) circuit (not shown). Therefore, the feed cable 4 realizes signal transmission from the RF circuit to the antenna assembly 1. The feed cable 4 is arranged in the lengthwise direction. A metal plate (not shown) is disposed on the first main surface 11 of the substrate. The feed cable 4 is also peeled to expose the outer conductor 42 to weld with the metal plate. Thus, the feed cable 4 can be fixed on the substrate reliably and the radiating strength of the dipole antenna 5 is enhanced.

Particularly referring to FIG. 2, the parasitic element 8 is made of conductive material and disposed on the second main surface 12 of the substrate. The parasitic element 8 comprises a first parasitic section 6 and a second parasitic section 7. A second slot 100 is defined between the first and the second parasitic sections 6 and 7, whose location is exactly corresponding to the first slot 10 on the first main surface 11 of the substrate. The first parasitic section 6 and the second parasitic section 7 have the same shape and are symmetrical with each other about the second slot 100. The first parasitic section 6 comprises a first patch 61, a second patch 62 and a third patch 63. The first patch 61 is in a rectangular shape. The first patch 61 is located corresponding to a horizontal portion of the first radiating section 21 and has a dimension nearly the same as that of the horizontal portion of the first radiating section 21. The second patch 62 is in a rectangular shape. The second patch 62 is separated from the first patch 61 and located corresponding to a distal end of a horizontal portion of the second radiating section 22. The third patch 63 is of a transverse U-shape with an opening facing to a lateral side of the substrate and comprising an upper arm 631 and a lower arm 632 both extending in the lengthwise direction parallel to the first patch 61. The third patch 63 is separated from the first patch 61 and the second patch 62. As the symmetrical relationship between the first and the second parasitic section 6 and 7, the second parasitic section 7 correspondingly comprises a first piece 71, a second piece 72 and a third piece 73 respectively symmetrical with the first patch 61, the second patch 62 and the third patch 63 of the first parasitic section 6. The third piece 73 comprises an upper arm 731 and a lower arm 732. The upper arm 731 of the third piece 73 is exactly under the feed cable 4. Thus, a radiating strength of the dipole antenna 5 when transmitting high-frequency signals is enhanced. Additionally, both upper arms 631 and 731 have a function of improving impedance matching of the dipole antenna. The parasitic element 8 arranged on the second main surface 12 of the substrate can enhance the antenna gain and widen the antenna bandwidth through coupling with the dipole antenna 5 arranged on the first main surface 11 of the substrate. The improvement effect can refer to FIGS. 3–9.

In terms of the preferred embodiment, the performance of the antenna assembly 1 is excellent. FIGS. 4–9 show the horizontally polarized and vertically polarized principle plane radiation patterns of the antenna assembly 1 operating at the resonant frequency of 2.484 GHz, 4.490 GHz and 5.850 GHz. Note that each radiation pattern of the antenna assembly 1 is close to corresponding optimal radiation pattern and there is no obvious radiating blind area, conforming to the practical use conditions of an antenna. Besides, the horizontally and vertically polarized principle planes of the antenna assembly 1 are also very good on other resonant frequencies in the operating bands. The ADS simulation result shows the peak gain and the average gain of the antenna assembly 1 are both high with excellent radiation pattern. In order to illustrate the effectiveness of the present invention, two tables are given below to show the average gain and the peak gain of the antenna assembly 1:

AVERAGE GAIN

| Frequency (GHz) | 2.412 | 2.440 | 2.484 | 4.940 | 4.970 | 4.990 | 5.250 | 5.550 | 5.850 |
|---|---|---|---|---|---|---|---|---|---|
| Vertical polarization (dBi) | 1.127 | 1.393 | 1.445 | 1.928 | 1.452 | 1.279 | 1.897 | 1.684 | 2.459 |
| Horizontal polarization (dBi) | −11.728 | −11.359 | −9.196 | −10.612 | −11.364 | −11.363 | −10.681 | −12.364 | −14.007 |

PEAK GAIN

| Frequency (GHz) | 2.412 | 2.440 | 2.484 | 4.940 | 4.970 | 4.990 | 5.250 | 5.550 | 5.850 |
|---|---|---|---|---|---|---|---|---|---|
| Vertical polarization (dBi) | 2.19 | 3.1 | 4.26 | 4.65 | 4.33 | 4.03 | 4.11 | 3.81 | 4.44 |

-continued

| PEAK GAIN | | | | | | | | | |
|---|---|---|---|---|---|---|---|---|---|
| Horizontal polarization (dBi) | −6.49 | −6.53 | −5.07 | −4.95 | −6.02 | −6.13 | −3.78 | −6.43 | −8.29 |

For most conventional dipole antennas, the average gain is about 1.2–1.5 dBi and the peak gain is about 2–3 dBi. The above tables show the average gain of antenna assembly 1 according to the preferred embodiment of the present invention is higher than 1.5 dBi and the peak gain is higher than 3 dBi at 4.940 GHz, 5.250 GHz, 5.550 GHz and 5.850 GHz.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly, comprising:

a substrate having opposite first and second surfaces;

an antenna arranged on the first surface of the substrate and comprising a radiating portion and a ground portion;

a feed cable comprising a first conductor electrically connected to said radiating portion and a second conductor electrically connected to said ground portion; and a parasitic element comprising at least two parasitic sections having the same shape and size arranged on the second surface of the substrate for increasing the gain of the antenna through coupling therewith, wherein the radiating portion and the grounding portion define a first slot therebetween, the two sections of the parasitic element define a second slot corresponding to the first slot.

2. The antenna assembly as claimed in claim 1, wherein the antenna is a dipole antenna having a symmetrical structure.

3. The antenna assembly as claimed in claim 2, wherein the antenna is a dual-band antenna having a first radiating section resonant at a first frequency band and a second radiating section resonant at a second frequency band.

4. The antenna assembly as claimed in claim 3, wherein at least one of the first and the second radiating sections has an L-shape.

5. The antenna assembly as claimed in claim 1, wherein the parasitic element is made of conductive material.

6. The antenna assembly as claimed in claim 1, wherein the antenna and the parasitic element have at least an overlapped portion located on the first and the second surfaces of the substrate.

7. The antenna assembly as claimed in claim 1, the first parasitic section comprises a first patch adjacent to the slot and a second patch away from the slot, the first and the second patches are separated from each other.

8. The antenna assembly as claimed in claim 7, wherein the antenna comprises a first radiating section and a second radiating section, the first patch having a portion overlapped with the first radiating section and the second patch having a portion overlapped with the second radiating section.

9. The antenna assembly as claimed in claim 1, wherein the parasitic element comprises a patch having a portion overlapped with the feed cable.

10. The antenna assembly as claimed in claim 1, wherein both said antenna and said parasitic element are symmetrically arranged on the corresponding first and second surfaces, respectively.

11. An antenna assembly comprising:

an elongated substrate defines two opposite first and second surface;

an antenna arranged on the first surface and including a radiating portion and a grounding portion essentially symmetrical with each other by two sides of an imaginary center line which extends in a transverse direction perpendicular to a lengthwise direction of said elongated substrate; and a feeder cable including at a front end thereof an inner conductor connected to the radiating portion and an outer conductor connected to the grounding portion; wherein the outer conductor is further exposed to an exterior at a position far away from the front end and mechanically and electrically connected to printed circuit board at said position.

12. The antenna as claimed in claim 11, wherein said feeder cable extends along said lengthwise direction.

13. The antenna as claimed in claim 11, wherein said radiating portion and said grounding portion respectively define first and second protruding tabs being oppositely symmetrical to each other and respectively connected to the inner conductor and the outer conductor at said front end of the feeder cable.

14. The antenna as claimed as claim 13, wherein each of said radiating portion and said grounding portion defines an L-shaped slot to divide the corresponding radiating portion or grounding portion into large and small regions for different frequencies.

15. The antenna as claimed in claim 14, wherein said large and small regions are linked to each other by one linear segment, and the corresponding protruding tab extends along and in alignment with said linear segment.

16. The antenna as claimed in claim 11, further including a parasitic element on the second surface of the substrate for increasing gains of the antenna through coupling therewith.

17. The antenna as claimed in claim 16, wherein said parasitic element defines two parts symmetrical to each other by two sides of said imaginary center line.

* * * * *